US009775486B2

(12) United States Patent
Dotterman et al.

(10) Patent No.: US 9,775,486 B2
(45) Date of Patent: Oct. 3, 2017

(54) CLEANING PAD WITH SUPPORT BODY

(71) Applicant: 3M INNOVATIVE PROPERTIES COMPANY, St. Paul, MN (US)

(72) Inventors: Perry S. Dotterman, Maplewood, MN (US); John J. Dyer, Shoreview, MN (US); Arthur V. Lang, Maplewood, MN (US); Robert J. Maki, Hudson, WI (US); Milind B. Sabade, Woodbury, MN (US); DanLi Wang, Shoreview, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 956 days.

(21) Appl. No.: 14/051,866

(22) Filed: Oct. 11, 2013

(65) Prior Publication Data

US 2014/0130827 A1 May 15, 2014

Related U.S. Application Data

(60) Provisional application No. 61/724,431, filed on Nov. 9, 2012.

(51) Int. Cl.
*A47L 13/44* (2006.01)
*A47L 13/16* (2006.01)
*A47L 13/34* (2006.01)

(52) U.S. Cl.
CPC ..... *A47L 13/44* (2013.01); *A47L 13/16* (2013.01); *A47L 13/34* (2013.01)

(58) Field of Classification Search
CPC ..... A47L 13/44; A47L 13/46; A47L 13/16
USPC ..... 15/144.1, 145, 231, 209.1–210.1
See application file for complete search history.

(56) References Cited

U.S. PATENT DOCUMENTS

| | | | | |
|---|---|---|---|---|
| 2,816,313 | A | 12/1957 | Beck | |
| 2,958,593 | A | 11/1960 | Hoover | |
| 3,058,139 | A * | 10/1962 | Dryden | A47K 7/028 15/150 |
| 3,537,121 | A | 11/1970 | McAvoy | |
| 3,837,988 | A | 9/1974 | Hennen | |
| 3,910,284 | A | 10/1975 | Orentreich | |
| 4,078,340 | A | 3/1978 | Klecker | |
| 4,227,350 | A | 10/1980 | Fitzer | |
| 5,212,847 | A * | 5/1993 | Melcher | A45D 40/28 15/209.1 |
| 5,865,935 | A | 2/1999 | Ozimek | |
| 6,023,810 | A | 2/2000 | Gessert | |
| 6,079,075 | A * | 6/2000 | Velez-Juan | A46B 7/04 15/143.1 |
| 6,155,620 | A * | 12/2000 | Armstrong | A01B 1/00 15/105 |
| 6,520,672 | B1 | 2/2003 | Whitney | |

(Continued)

FOREIGN PATENT DOCUMENTS

| | | |
|---|---|---|
| CN | 201550826 | 8/2010 |
| WO | 2009/125376 | 10/2009 |

OTHER PUBLICATIONS

International Search Report, PCT/US2013/067498, mailed Feb. 5, 2014, 5 pages.

*Primary Examiner* — Laura C Guidotti
(74) *Attorney, Agent, or Firm* — Emily M. Van Vliet; Kenneth B. Wood

(57) ABSTRACT

A resilient cleaning pad with a support body a portion of which is mechanically secured in a slit-like cavity of the cleaning pad.

7 Claims, 11 Drawing Sheets

(56) References Cited

U.S. PATENT DOCUMENTS

| | | | | |
|---|---|---|---|---|
| 7,032,270 | B2 | 4/2006 | Vitantonio | |
| 7,146,676 | B2 | 12/2006 | Kubes | |
| 7,293,317 | B2 | 11/2007 | Tsuchiya | |
| 8,046,865 | B2 | 11/2011 | Knopow | |
| 2001/0044980 | A1* | 11/2001 | Duplessis | A47L 13/12 15/121 |
| 2006/0070197 | A1 | 4/2006 | May | |
| 2006/0171767 | A1 | 8/2006 | Hoadley | |
| 2008/0216260 | A1 | 9/2008 | Silverman | |
| 2009/0255075 | A1 | 10/2009 | Carlson | |
| 2009/0286203 | A1 | 11/2009 | Sanchez | |
| 2011/0225755 | A1 | 9/2011 | Carlson | |

* cited by examiner

CLEANING PAD WITH SUPPORT BODY

BACKGROUND

Cleaning tools often comprise a cleaning pad and a handle for grasping. Often, the cleaning pad may need replacing, while the handle may still be in excellent working condition.

SUMMARY

Herein is disclosed a resilient cleaning pad with a support body a portion of which is mechanically secured in a slit-like cavity of the resilient cleaning pad. These and other aspects of the invention will be apparent from the detailed description below. In no event, however, should the above summaries be construed as limitations on the claimable subject matter, whether such subject matter is presented in claims in the application as initially filed or in claims that are amended or otherwise presented in prosecution.

Like reference numbers in the various figures indicate like elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. As used herein, terms such as front, forward, forwardly, forwardmost, forward-facing, etc., denote a direction toward the working end of a cleaning tool or a component thereof (e.g., toward the left side of FIG. 4); terms such as rear, rearward, rearwardly, rearwardmost, rear-facing, etc. denote a direction toward the grippable end of a cleaning tool (e.g., toward the right side of FIG. 4). As used herein, terms such as outward, outwardly, outward-facing, outwardmost, etc. denote a direction outward from the interior of a cleaning pad, support body and/or handle; terms such as inward, inwardly, inward-facing, inwardmost, etc. denote a direction inward toward the interior of a cleaning pad, support body and/or handle. As used herein as a modifier to a property or attribute, the term "generally", unless otherwise specifically defined, means that the property or attribute would be readily recognizable by a person of ordinary skill but without requiring absolute precision or a perfect match (e.g., within +/−20% for quantifiable properties). The term "substantially", unless otherwise specifically defined, means to a high degree of approximation (e.g., within +/−10% for quantifiable properties) but again without requiring absolute precision or a perfect match. Terms such as same, equal, uniform, constant, strictly, and the like, are understood to be within the usual tolerances or measuring error applicable to the particular circumstance rather than requiring absolute precision or a perfect match.

DETAILED DESCRIPTION

Figure 1:
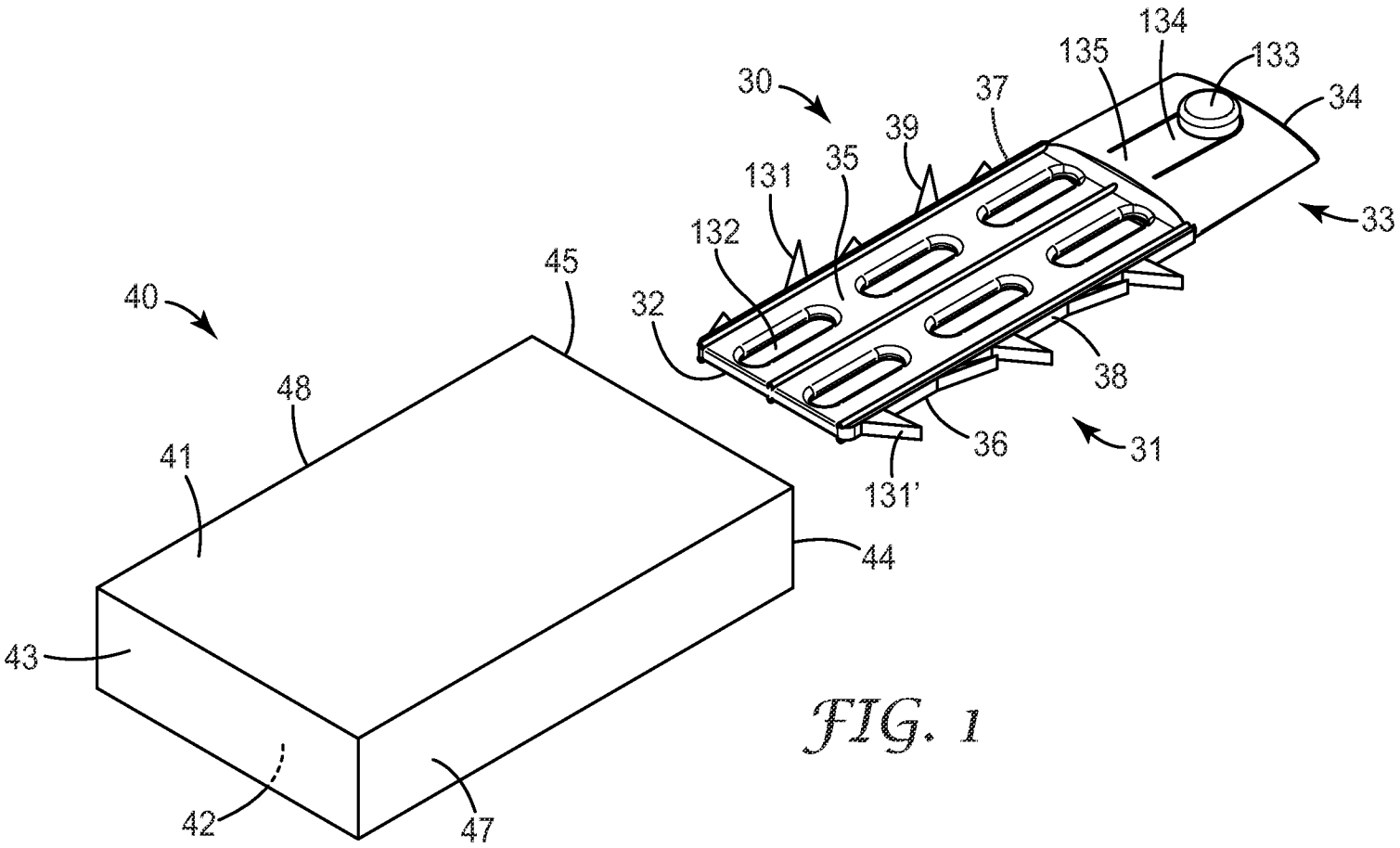
FIG. 1 is a side-top perspective exploded view of an exemplary cleaning pad and an exemplary support body.
Figure 2:
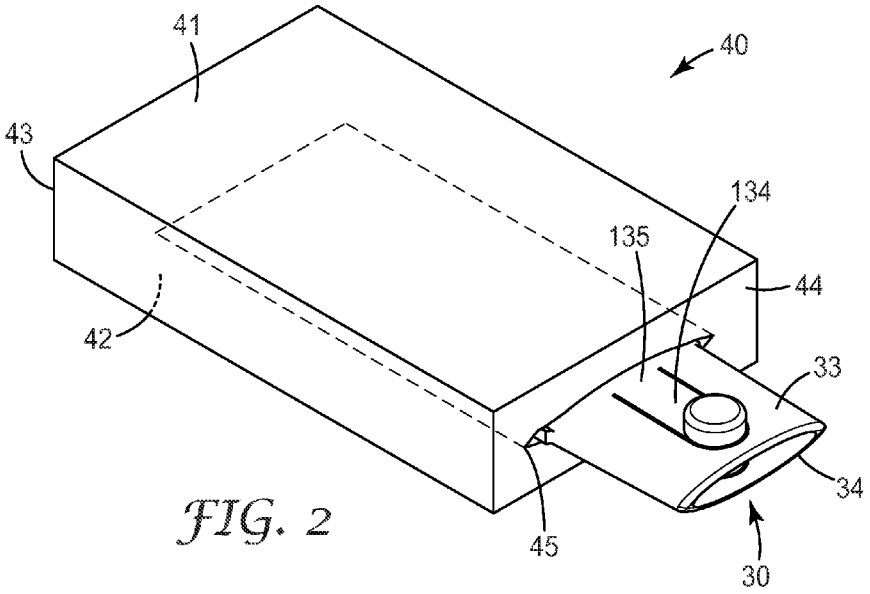
FIG. 2 is a side-rear perspective assembled view of the cleaning pad and support body of FIG. 1.

Shown in generic representation in FIGS. 1 and 2 is an exemplary resilient cleaning pad 40 that may be used for cleaning (e.g., scrubbing, scouring, etc.) of any desired surface, e.g. surfaces of commercial fryers as found in restaurants and the like. Cleaning pad 40 comprises first and second major cleaning surfaces 41 and 42, front end 43 and rear end 44, and first and second minor lateral edges 47 and 48. Cleaning pad 40 further comprises a slit-like cavity 45 (most easily seen in FIG. 2) that is defined by interior surfaces of cleaning pad 40 and that is rearwardly open-ended. By slit-like is meant that cavity 45 comprises a front-rear dimension (e.g., length) and a lateral dimension (e.g., width) that are each at least 5 times as long as the shortest dimension (e.g., thickness) of the slit-like cavity. Slit-like cavity 45 may conveniently have a length that is oriented at least generally parallel to a front-rear axis of cleaning pad 40, and a width that is oriented at least generally perpendicular to the front-rear axis of cleaning pad 40, and with a shortest (thickness) dimension that is oriented at least generally perpendicular to major cleaning surfaces 41 and 42 of cleaning pad 40. However, slit-like cavity 45 may, in some embodiments, be e.g. generally square in front-rear and lateral dimensions; or, the lateral dimension may exceed the front-rear dimension.

Cleaning pad 40 further comprises a support body, with exemplary cleaning pad 40 and exemplary support body 30 shown in side-top perspective exploded view in FIG. 1 and in side-rear assembled view in FIG. 2. Support body 30 comprises a first, major front portion 31 that, when cleaning pad 40 and support body 30 assembled together, resides within open-ended slit-like cavity 45 of cleaning pad 40 and is mechanically secured to cleaning pad 40 (e.g., to interior surfaces of cleaning pad 40 that define slit-like cavity 45), so that cleaning pad 40 and support body 30 are non-separably attached to each other. Support body 30 may comprise a front end 32, a rear end 34, a first major surface 35 and a second major surface 36, and first and second minor lateral edges 37 and 38. In some embodiments, support body 30 may be mechanically secured to cleaning pad 40 by way of major front portion 31 of support body 30 comprising a plurality of protrusions (e.g., barbs) 39 that are configured to entangle with fibers of cleaning pad 40. Other methods are possible, as discussed later herein. By non-separably attached is meant that support body 30 and cleaning pad 40 cannot be separated (detached) from each other by hand by a user (without the use of special tools); and/or, that they cannot be separated from each other without unacceptably damaging or destroying one or both of them.

In some embodiments, plurality of protrusions 39 may take the form of barbs, e.g. rearwardly-angled barbs 131, as shown in exemplary manner in FIG. 1. By rearwardly-angled is meant that the tips of such barbs are raked toward the rear end of support body 30. (In other embodiments, such barbs may protrude in a non-rearwardly angled manner). In specific embodiments, rearwardly-angled barbs 131 may be provided as a first set of barbs 131 that protrude from first minor lateral edge 37 of support body 30, and a second set of barbs 131' that protrude from second minor lateral edge 38 of support body 30. In specific embodiments, each set of barbs may be a staggered set of barbs, as shown in exemplary embodiment in FIG. 3. By staggered is meant that, on a given minor lateral (side) edge of the support body, nearest-neighbor pairs of barbs are configured so that one of the barbs (e.g., 137) of the pair protrudes generally in a first direction away from the major plane of support body 30 (e.g., at least slightly above the major plane, in the view of FIG. 3); and the other barb (e.g., 137') of the pair protrudes generally in a second, different direction away from the major plane (e.g., at least slightly below the major plane, in the view of FIG. 3).

In some embodiments, first and/or second major surfaces 35 and/or 36 of support body 30 may comprise a plurality of barbs that are configured to entangle with fibers of cleaning pad 40. In various embodiments, such major-surface-originating barbs (which be e.g. rearwardly-angled, or may be e.g. generally or substantially normal to the major plane of support body 30), may act, in part or alone, to facilitate the mechanical securing of the major front portion 31 of support body 30 to the interior surfaces of the cleaning pad. That is, in various embodiments such major-surface originating barbs may be the only barbs present, or they may be present in combination with the above minor-lateral-edge-originating barbs to enhance the functioning thereof. Exemplary versions of such barbs are described and discussed in further detail later herein.

In some embodiments, the above-described mechanical securing may be the only mechanism by which cleaning pad 40 and support body 30 are non-separably attached to each other. In some specific embodiments of this type, no adhesive of any kind (e.g., glue, hot-melt adhesive, pressure-sensitive adhesive, etc.) is used to secure pad 40 and support body 30 to each other, nor are any portions of any fibers of pad 40 melt-bonded or ultrasonically welded to any portion of support body 30. Moreover, in some particular embodiments, no mechanical fastener (other than the above-described barbs) or fasteners are used to aid the non-separable attaching of the cleaning pad and the support body to each other. (In other embodiments as discussed later herein, additional fasteners or fastening mechanisms, such as e.g. rivets or sewn seams, may be used). Major front portion 31 of support body may be configured to fit snugly within slit-like cavity 45 of cleaning pad 40; and, the lateral width of support body 30 and/or the distance to which barbs protrude therefrom, may be chosen to ensure that, upon inserting of major front portion 31 of support body 30 into slit-like cavity 45 (which process may conveniently done in the manufacturing process rather than by an end-user) barbs are adequately mechanically entangled with fibers of cleaning pad 40, to achieve the aforementioned non-separable attaching of pad 40 and support body 30 to each other. In some embodiments, major front portion 31 of support body 30 may comprise one or more through-passages 132 that pass through the shortest dimension of support body 30 (as shown in FIG. 1), which through-passages may allow liquid to pass therethrough so as to facilitate rinsing and flushing of cleaning pad 40 (e.g., so that cleaning pad 40 may be reused a number of times). In some embodiments, front end 32 of support body 30 may be tapered so as to facilitate the insertion of major front portion 31 of support body 30 forwardly into slit-like cavity 45 of cleaning pad 40.

Support body 30 may also comprise a second, major rear portion 33, which, upon the assembly of support body 30 and cleaning pad 40 together, protrudes rearwardly outward from open-ended slit-like cavity 45 and comprises an attachment mechanism configured to be detachably attached to a handle as explained later herein. Conveniently, major front portion 31 and major rear portion 33 may both be portions the same unitary (single-piece) support body 30 (that is, support body 30, including portions 31 and 33 thereof and other components thereof, may all comprise components of a single, integral part that is molded in a single molding operation). In some embodiments, support body 30 may comprise a single unitary piece with a generally planar shape (except for e.g. the aforementioned barbs). In various embodiments, either or both of first, major front portion 31 and second, major rear portion 33 of support body 30 may be hollow, e.g. so as to accept a reinforcing member thereinto as discussed later herein.

Support body 30 may be made of any suitable material. In some embodiments, support body 30 may be made of a suitable moldable thermoplastic polymer composition, which composition may comprise any suitable filler, reinforcing agent, etc., as may be desired to provide the desired physical properties (strength, stiffness, etc.). In specific embodiments, support body 30 may be comprised of molded polyamide (e.g., any suitable injection molding grade of nylon). In some embodiments, support body 30 may be an inflexible support body, meaning that it comprises a bending stiffness at least in the range of that supplied by a sheet of molded polyamide that is 2 mm in shortest (thickness) dimension. In various embodiments, such a bending stiffness may be e.g. at least five, ten, or twenty times the bending stiffness of cleaning pad 40.

Figure 4:
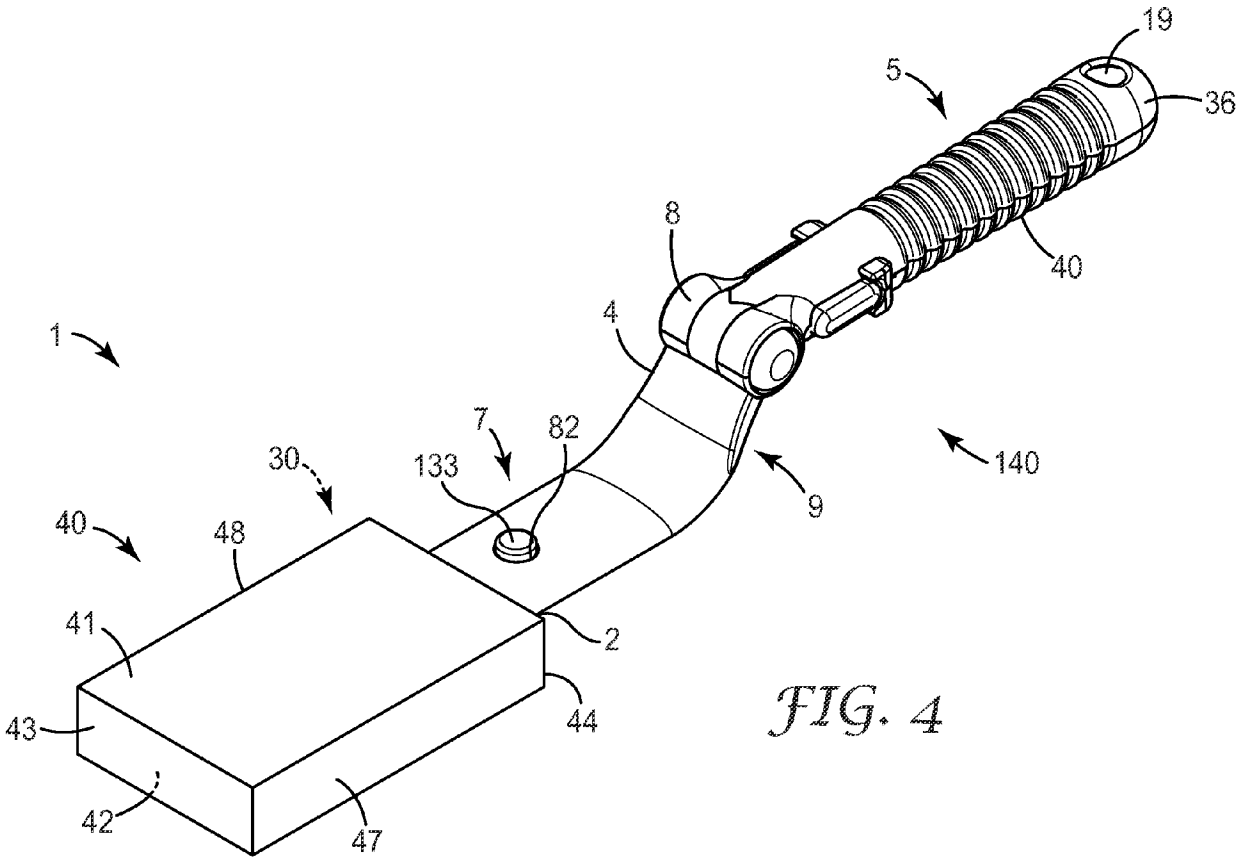
FIG. 4 is a side-top perspective view of the cleaning pad and support body of FIG. 1, as detachably attached to an exemplary handle to form a cleaning tool.

Cleaning pad 40 may be detachably attached (by way of support body 30) to an elongated handle 140 to form a cleaning tool 1, as shown in exemplary embodiment in FIG. 4. By detachably attachable is meant that support body 30 (and thus cleaning pad 40) can be manually attached to handle 140 by hand by a user, without the use of any special tools (e.g., pliers, screwdriver, etc.), and is further meant that support body 30 can be likewise manually detached from handle 140 by hand by a user, without unacceptably damaging or destroying any of the cleaning pad, support body and/or handle. Handle 140 may comprise an elongated shaft 4 with at least front portion 7 and rear, grippable portion 5. Grippable portion 5 may comprise a long axis (noting that an item does not necessarily have to be perfectly straight to have a long axis, as long as a long axis can be distinguished), and may comprise grippable material 6. Grippable material 6 may comprise a separate material mounted onto grippable portion 5 of shaft 4; or, portion 5 of shaft 4 and grippable material 6 thereof may be integrally comprised of the same material. In particular, if shaft 4 (or at least portion 5 thereof) made of metal, grippable material 6 may comprise a material (e.g., a molded coating) with thermal conductivity lower than that of the metal of shaft 4. Grippable end 3 of shaft 4 may optionally comprise a hole 19, or any other suitable pin or bracket, from which tool 1 may be suspended if desired.

Figure 3:
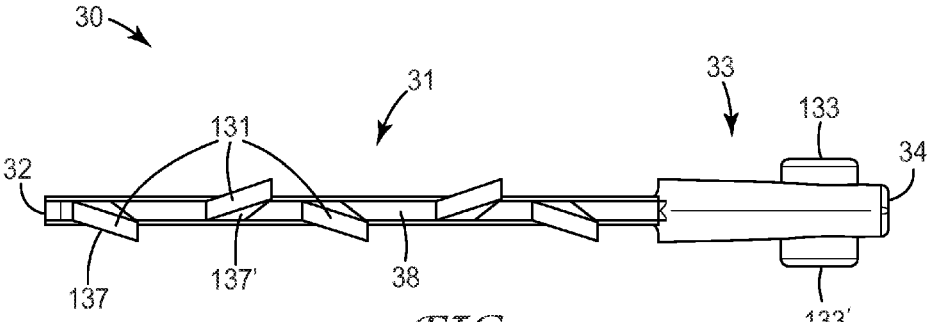
FIG. 3 is a side view of the support body of FIG. 1.

Cleaning pad 40 may be detachably attached to handle 140 by way of an attachment mechanism of major rear portion 33 of support body 30 being detachably attached to a complementary attachment mechanism of front portion 7 of shaft 4 of handle 140. In the exemplary embodiment illustrated in FIGS. 1, 4 and 8, front portion 7 of handle 140 may comprise a hollow interior with a front opening 81 provided in front end 2 on that at least a rearmost section of major rear portion 33 of support body 30 may be rearwardly inserted thereinto. In the illustrated embodiment, the attachment mechanism of the support body comprises at least one boss 133 that is supported by deflectable flange 134 which flange is deflectably connected to support body 30 by living hinge 135 so that boss 133 is outwardly-biased relative to support body 30 by living hinge 135. (In specific embodiments, two oppositely-facing, deflectably supported, outwardly-biased bosses 133 and 133' can be provided, as shown in FIG. 3.) Major rear portion 33 of support body 30 may be hollow so that the boss or bosses can be deflected thereinto (which arrangement is most easily seen in FIG. 2) to allow that major rear portion 33 can be rearwardly inserted into front opening 81 of handle 140. The deflection of the boss or bosses may be performed manually, e.g. by way of the user manually squeezing the boss inwardly; or, the boss may be beveled on its rearward edge so that the process of pressing the boss rearwardly against the rim of front opening 81 of handle 140 (in the process of inserting major rear portion 33 of support body 30 into handle 140) will cause the boss to automatically deflect inwards without any other action by the user being necessary. Continued urging of major rear portion 33 of support body 30 rearward will cause boss 133 to be aligned with through-hole 82 of handle 140, in which case the outward biasing force provided by living hinge 135 will cause boss 133 to move outward so as to reside within through-hole 82 and will thus attach support body 30 (and thus cleaning pad 40) to handle 140 as shown in FIG. 4. When it is desired to detach support body 30 and cleaning pad 40 from handle 140, the boss or bosses can be depressed inwardly and the support body can then be pulled forwardly so as to detach it from handle 140. It will thus be appreciated that in at least some embodiments, no direct attachment of cleaning pad 40 to any portion of handle 140 may be present; that is, in such embodiments the only way that pad 40 is attached to handle 140 may be by way of the attachment of support body 30 to handle 140. It will be further appreciated that the above arrangement is only one exemplary way in which support body 30 and cleaning pad 40 may be detachably attached to handle 140. Any suitable method may be used, as long as support body 30 can be manually attached to handle 140, and manually detached therefrom, by hand by a user, without the use of any special tools (e.g., pliers, screwdriver, etc.).

It will be further appreciated that any desired item can be attached to handle 140 (in place of cleaning pad 40), as long as the item comprises an attachment mechanism that is complementary to the attachment mechanism of handle 140. Such an item might be disposable, or might be non-disposable (e.g., with a usable lifetime on the same order as that of the handle). Such an item might be a scraping blade, a spatula, a wire brush, or the like, and in some embodiments might be provided to a user in a kit with handle 140, and cleaning pad 40.

Figure 5:
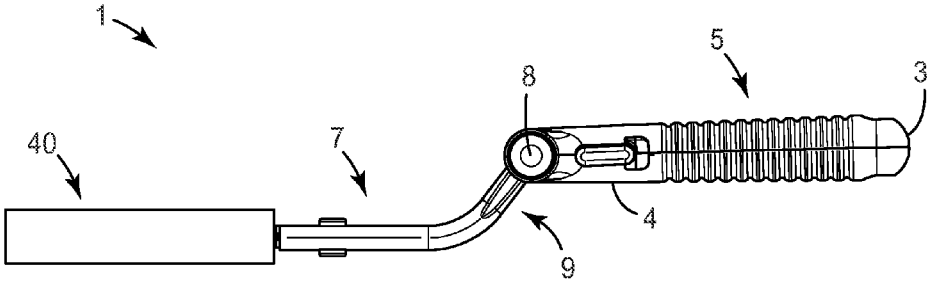
FIG. 5 is a side view of the cleaning tool of FIG. 4, with a grippable portion of the handle in a first position.

In some embodiments, handle 140 may comprise an angled portion 9 that is connected to grippable portion 5 and to front portion 7 in such manner that a front-rear long axis of front portion 7 of handle 140, when viewed in aside view as in FIG. 5, is generally parallel to, but spaced away from, a front-rear long axis of grippable portion 5. Such arrangements are termed offset handle arrangements. In this specific context, by generally parallel is meant within plus or minus 30 degrees; in further embodiments, a long axis of front portion 7 may be oriented within plus or minus 20 degrees, or 10 degrees, of the long axis of portion 5 of handle 140, and in some particular embodiments such an axis may be parallel to a long axis of portion 5 of handle 140 when viewed in side view. (Again, it is not necessary that a portion 5, or portion 7, be strictly linear in order to have a recognizable long axis.)

In some embodiments, angled portion 9 may be oriented (angled) away from a long axis of front portion 7 by at least about 10 degrees, and in various embodiments may be oriented away from the long axis of front portion 7 by at least 25 degrees, or by at least 45 degrees, or by at least 75 degrees. In further embodiments, angled, portion 9 may be oriented away from the long axis of front portion 7 by at most 90, 60, or 25 degrees. In various embodiments, the length of angled portion 9 may be at least about 1, 2, 4, or 8 cm; in further embodiments, the length of angled portion 9 may be at most about 16, 8, or 4 cm. In various embodiments, the length of front portion 7 may be at least 1, 2, 4, or 8 cm; in further embodiments, the length of front portion 7 may be at most 16, 8, 4, or 2 cm. Angled portion 9 may be (as in the exemplary embodiment of FIGS. 4 and 5) non-rotatably (and, non-separably) attached to front portion 7; for example, portions 9 and 7 may be integral portions of the same shaft 4 of handle 140. In particular embodiments of this type, angled portion 9 and front portion 7 may be integral portions of a single unitary molded plastic piece (as shown e.g. in the illustrative embodiment of FIG. 8).

In various embodiments, the above-mentioned front-rear long axis of front portion 7 (which, in many embodiments, may be at least generally parallel to a front-rear long axis of support body 30) may be spaced away from the long axis of grippable portion 5 (when viewed in side view as in FIG. 5) a distance of at least about 1, 2, 4, or 8 cm. (This spacing may be achieved e.g. by the choice of the angle and length of portion 9, as can be visualized most easily with reference to FIGS. 4 and 5.) In further embodiments, such a front-rear long axis of front portion 7 of handle 140 may be spaced from a long axis of grippable portion 5 a distance of at most 24, 16, 8, or 4 cm.

It will be appreciated that any of grippable portion 5, angled portion 9, and front portion 7 can comprise separate pieces that are assembled together; or they can all comprise one continuous piece, unitary with appropriate portions and bends incorporated therein. In some embodiments, shaft 4 may be rigid throughout its entire length. Although shown as generally straight in the exemplary illustrations herein, front portion 7 does not necessarily have to be strictly straight or even generally straight. In general, any suitable combination of any design of a grippable portion, an angled portion, and a front portion, that results in an offset arrangement as disclosed herein, may be used if desired.

In some embodiments, handle 140 (e.g., shaft 4 thereof) may comprise a hinged connection that hingedly connects grippable portion 5 of shaft 4 to angled portion 9 of shaft 4, and/or a hinged connection that hingedly connects angled portion 9 to front portion 7 of handle 140. In the exemplary embodiment shown in FIGS. 4 and 5, hinged connection 8 hingedly connects grippable portion 5 of handle 140 to angled portion 9 of handle 140 (which portion 9 is connected to front portion 7 of handle 140). Such a hinged connection can allow the angle between grippable portion 5 and front portion 7 (and hence, between grippable portion 5 and cleaning pad 40) to be varied as desired by a user (as shown in exemplary embodiment by comparison of FIGS. 5, 6 and 7). In some embodiments, portions 5, 7 and 9 of handle 140 (e.g., substantially the entirety of shaft 4), may be comprised of a rigid material (e.g., a rigid metal), with the only ability of handle 140 to bend or flex to any significant extent being provided by hinged connection 8 between portions of shaft 4.

Figure 6:
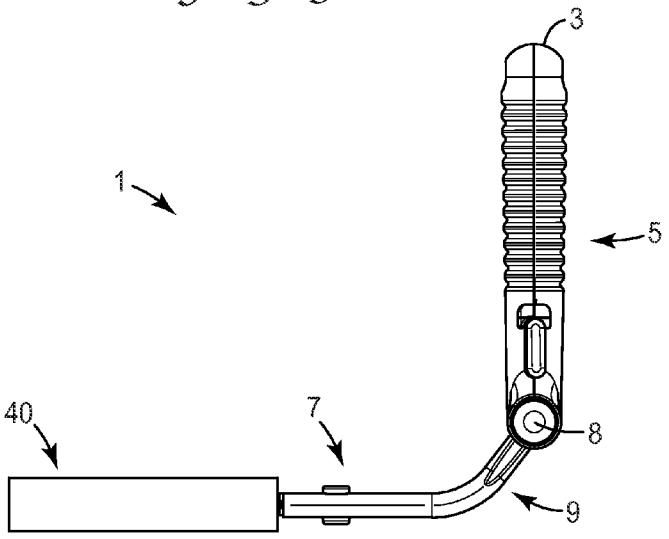
FIG. 6 is a side view of the cleaning tool of FIG. 4, with the grippable portion of the handle in a second position.
Figure 7:
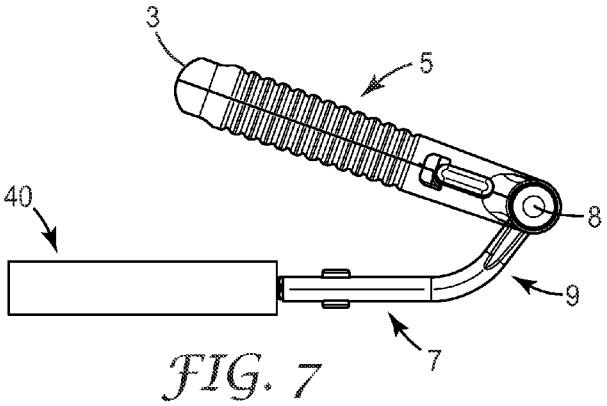
FIG. 7 is a side view of the cleaning tool of FIG. 4, with the grippable portion of the handle in a third position.

Such a hinged connection can allow grippable portion 5 to be moved away from the position shown in FIGS. 4 and 5 (which position, in which a long axis of portion 5 of handle 140 is at least generally parallel to a long axis of front portion 7 of handle 140, will be termed a first position for reference herein). In various embodiments, such a hinged connection may allow the angle between grippable portion 5 and front portion 7, to be changed to at least 20, 40, 60, or 80 degrees (when viewed in side view) away from the above-mentioned first position. For example, in FIG. 6 is shown a second position in which the long axis of grippable portion 5 is approximately perpendicular to the long axis of front portion 7 (that is, in this second position, grippable portion 5 is angled about 90 degrees away from the first position). In further embodiments grippable portion 5 can be hingedly rotated even further away from the first position, e.g. to an angle of about 110, 130, or even 150 degrees or more. Such a case, which is shown in exemplary embodiment in FIG. 7, can provide that a part of grippable portion 5 of handle 140 is in overlapping relation with a part of front portion 7 of handle 140. In further embodiments, a part of grippable portion 5 can be in overlapping relation with a part of cleaning pad 40. In this context, overlapping relation with pad 40 means that at some position on pad 40, a line can be drawn through the pad from one major surface to another (e.g., from surface 42 to surface 41), generally perpendicular to the major surfaces of the pad, which line when extended intersects some part of grippable portion 5 of handle 140. And, although not shown in any Figure, other positions of grippable portion 5 of handle 140 may be provided. For example, in some embodiments, a fourth position may be provided which is intermediate between the above-described second and third positions and in which, for example, the long axis of grippable portion 5 may be generally parallel with a long axis of angled portion 9 of handle 140.

Thus in various embodiments, handle 140 may be provided with a hinged connection 8 so that grippable portion 5 may be moved from the afore-mentioned first position, into one, two, three, four or even more positions. Hinged connection 8 may be arranged so that the angle between grippable portion 5 and front portion 7 can be set only in certain increments (e.g., of 10 degrees, 20 degrees, or 30 degrees); or it may be arranged so that any angle within these overall limits can be provided. In some embodiments, a mechanism may be provided so that hinged connection 8 can be unlocked to permit the angle to be changed, after which the mechanism may be locked so that the desired angle is maintained even when significant force is placed on tool 1.

In some embodiments, hinged connection 8 may be provided and configured so that grippable portion 5 may be placed into one of several predetermined angles (positions). One exemplary arrangement for achieving this is shown in exploded, view in FIG. 8. In such an arrangement, hinged connection 8 comprises pivot hinge 95 that can be non-rotatably attached to angled portion 9 of handle 140 (e.g., pivot hinge 95 can comprise projection 96 that can be inserted into a receptacle in the rear end of angled portion 9 and may be secured therein in any manner, e.g., by mechanical fastening, by an adhesive, etc.). Pivot hinge 95 may further comprise laterally-oriented through-hole 193 (defined by collar 196) through which can pass shanks of hinge-bolt members 97 and 197, which members can slidably mate together to collectively forma hinge-bolt about which grippable portion 5 of handle 140 can be rotated relative to angled portion 9 of handle 140. In the illustrated embodiment, grippable portion 5 is provided by two complementary pieces 91 and 92 that can be mated to each other to form grippable portion 5 with a hollow cavity in at least a portion thereof, which hollow portion can house a mechanism that can be actuated to unlock grippable portion 5 so that it can be rotated away from e.g. the first, second, or third, position, and into another position. In the illustrated embodiment, such an actuating mechanism comprises piston 99 that has a front end that can protrude into an aperture (e.g., aperture 194) in collar 196 of pivot hinge 95. When the front end of piston 99 is thus seated into an aperture of collar 196 of pivot hinge 95, the physical interference of piston 99 with collar 196 can minimize or prevent rotation of grippable portion 5 away from its current position. Thus, it can serve to lock grippable portion 5 in a desired position.

When it is desired to rotate grippable portion 5 to a new position, buttons 98 and/or 98' can be pushed laterally inward, which buttons will exert rearward force on wings 191 of piston 99 and will thus overcome the forward-biasing force supplied by biasing member (e.g., spring) 192 so that the front end of piston 99 is withdrawn from the aperture of collar 196 sufficiently far as to allow rotation of grippable portion 5. The pressure on buttons 98 and 98' may be released as soon as the rotation commences. Thus, when grippable portion 5 has been sufficiently rotated that the front end of piston 99 has traveled circumferentially far enough around collar 196 to encounter another aperture 194', the forward-biasing force of member 192 can cause piston 99 to move forward into aperture 194' and thus lock grippable portion 5 in this new position. Thus in this manner, the locking of grippable portion 5 in a new position can be automatic (that is, it may occur upon sufficiently rotating grippable portion 5 to the desired position, without necessarily requiring a separate manipulation (e.g., turning a handle, etc.) by the user). It will be appreciated that a desired number of predetermined positions of grippable portion 5 relative to angled portion 9, front portion 7, and support body 30, can be provided by supplying the desired number of apertures 194 in collar 196. Likewise, the angular locations of the various positions can be predetermined by the locations in which the apertures are placed, around the circumference of collar 196. Components such as pivot hinge 95 and piston 99 may be made of metal (e.g., aluminum, steel, etc.), if desired, with other components (e.g., halves 91 and 92 of grippable portion 5, buttons 98 and 98', etc.), being made of e.g. injection molded plastic. In other embodiments, the entirety of grippable portion 5 of handle 140, and the entirety of hinged connection 8, may be made of metal components with the optional exception of buttons 98 and 98'. It will also be appreciated that the above is merely one exemplary manner in which a multipositionable handle may be provided and that many other arrangements are possible.

Figure 8:
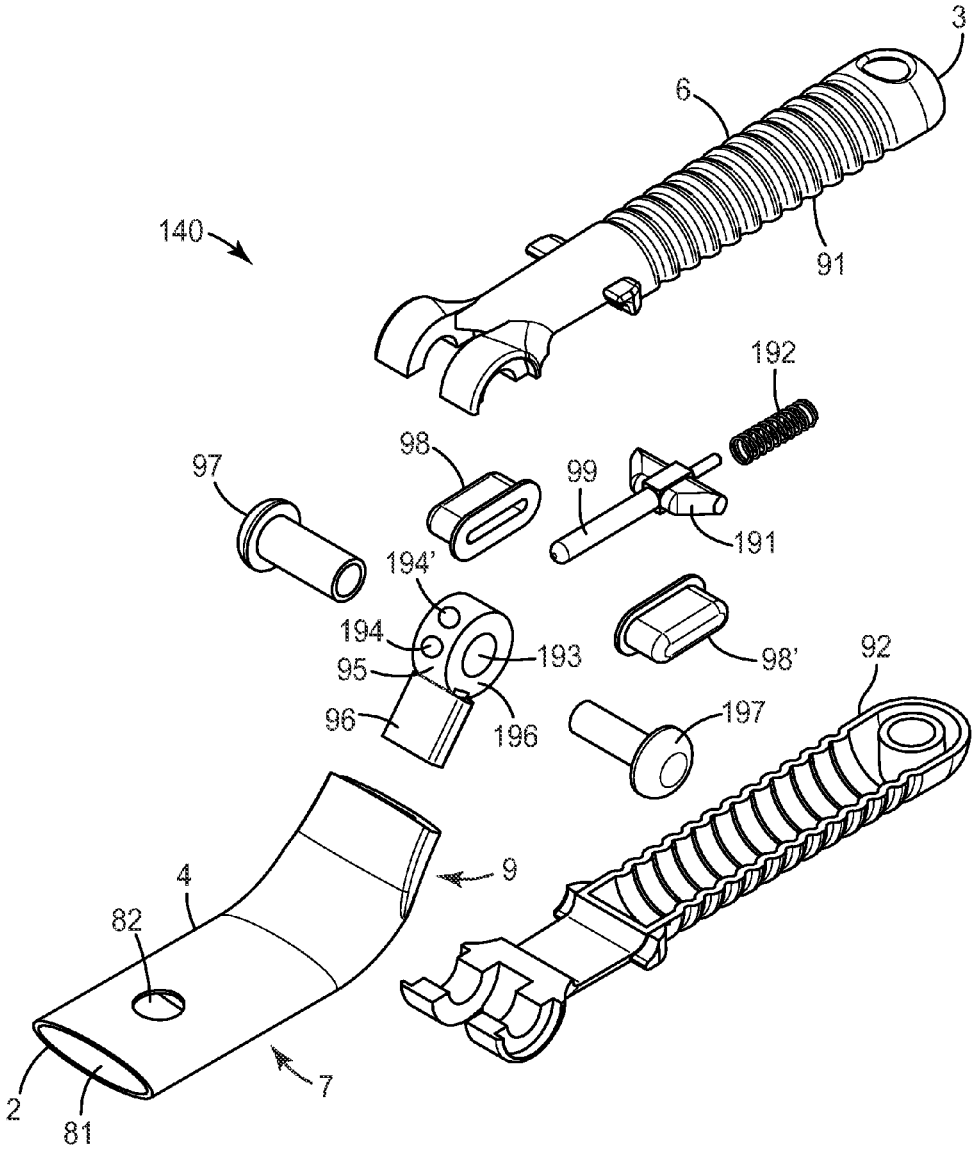
FIG. 8 is a side-top perspective view of the exemplary handle of FIG. 4, with the handle shown in exploded view to show an exemplary hinged connection thereof.
Figure 9:
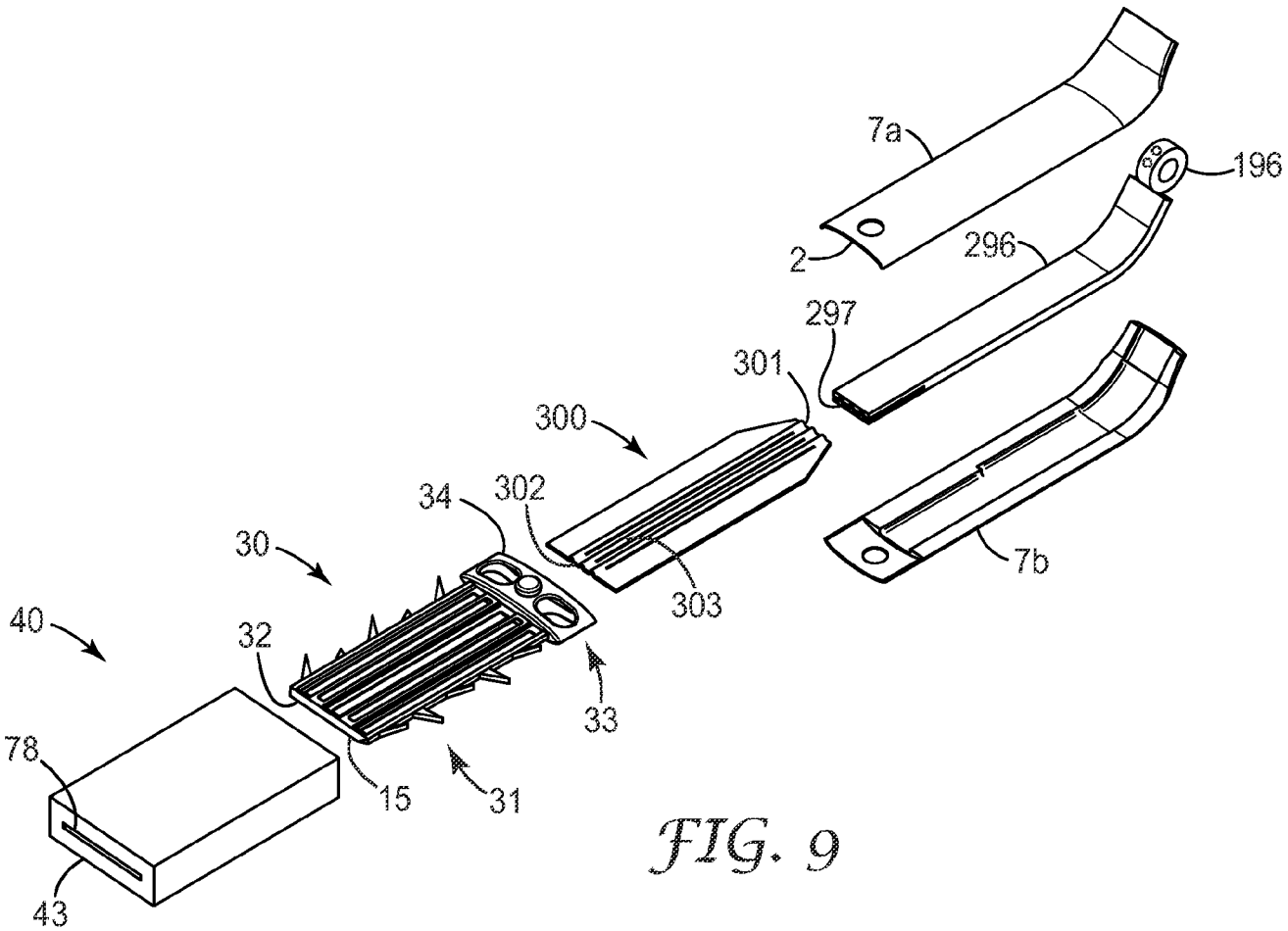
FIG. 9 is a side-top perspective exploded view of another exemplary cleaning pad, support body, and portion of a handle.

Some other features and designs that may be used are depicted in exemplary manner in FIG. 9 (in FIG. 9, certain components of rear, grippable handle portion 5 are omitted for ease of presentation; such components may be e.g. similar or identical to those shown in FIG. 8). In one such exemplary design, rather than pivot hinge 95 comprising relatively short projection 96 as shown in FIG. 8, pivot hinge 95 can comprise a projecting beam 296 that may extend along a portion, or substantially along the entirety, of front portion 7 of handle 140. Such an arrangement may provide enhanced stiffness of front portion 7 as desired. Beam 296 may be made of any suitable material (e.g., a metal such as aluminum, cast or stamped stainless steel, etc.).

In some embodiments, handle 140 may comprise one or more reinforcing members that may extend forwardly from front portion 7 of handle 140, so that when handle 140 and support body 30 of cleaning pad 40 are mated to each other, at least a forward portion of the reinforcing member supports (e.g., resides within the hollow interior of) major rear portion 33 of support body 30, major front portion 31 of support body 30, or both. Such a reinforcing member may help brace support body 30 and add mechanical strength and/or stiffness thereto. An exemplary reinforcing member 300 is shown in illustrative embodiment in FIG. 9; in the particular design depicted, reinforcing member 300 extends forwardly not only through major rear portion 33 of support body 30, but also extends forwardly through substantially most of major front portion 31 of support body 30 (toward front end 32 of support body 30). In various embodiments, reinforcing member 300 may forwardly extend to any desired position along the front-rear length of support body 30.

Reinforcing member 300 may be integrally formed with front portion 7 of handle 140; or it may be provided by a separately made member that may be attached to front portion 7 of handle 140. Reinforcing member 300 may be made of any suitable material, e.g. cast or stamped stainless steel, aluminum, molded plastic, and so on. If desired, the portion of the hollow interior of support body 30 into which at least a forward portion of reinforcing member 300 will reside, may be shaped and sized so as to seat that portion snugly therein, to enhance the ability of the reinforcing member to brace support body 30. Any number of such reinforcing members may be used, as desired. As illustrated in FIG. 9, in particular embodiments in which projecting beam 296 is provided, rear end 301 of reinforcing member 300 may be connected (e.g., attached) to a front end of beam 296. In the illustrated embodiment, the front end of beam 296 comprises forwardly-open slot 297 that is shaped to accept rear end 301 of reinforcing member 300 thereinto. In the illustrated example, member 300 comprises longitudinally-oriented corrugations 303, and slot 297 is shaped and sized to match. In various embodiments, member 300 may comprise an interference fit into slot 297; and/or one or more mechanical fasteners or adhesives may be used.

It will be noted that (whether reinforcing member 300 is integrally formed with front portion 7 of handle 140 or is attached thereto) in some embodiments, reinforcing member 300 may be a permanent part of handle 140 (that is, member 300 is not disconnectable therefrom). In other embodiments, reinforcing member 300 may be disconnectable from handle 140, but may be re-usable. That is, reinforcing member 300 may be disconnected from handle 140 (e.g., when a cleaning pad/support body is removed from handle 140 for disposal), and may then be seated within a replacement support body/cleaning pad and reconnected to handle 140 when the replacement support body/cleaning pad is mounted on handle 140.

Still another useful design feature is shown in FIG. 9. In some embodiments, major front portion 31 of support body 30 (e.g., front end 32) may comprise a scraping blade 15 (e.g. with a long axis that, e.g. on average, may be oriented generally normal to a long axis of support body 30), as seen in exemplary manner in FIG. 9. Scraping blade 15 may comprise any suitable material that may be used to scrape adhered material off a surface, and may be integrally formed with the rest of support body 30 (as in FIG. 9); or, it may be a separate piece (e.g., a metal blade) that is embedded partially in, or otherwise attached to, support body 30, so as to e.g. protrude forwardly from front end 32 of support body 30. In particular embodiments, front end 32 of support body 30 may comprise a slit through which a front end 302 of reinforcing member 300 may protrude, so that front end 302 of reinforcing member 300 may provide scraping blade 15.

Regardless of how such a scraping blade 15 may be provided, in some embodiments a through-hole 78 may be provided in cleaning pad 40 (e.g., in front end 43 of cleaning pad 40, as shown in FIG. 9), which through-hole may be sized and shaped so as to allow at least a front edge of scraping blade 15 to be positioned evenly therewith or to protrude therethrough.

Another feature shown in FIG. 9 is that front portion 7 and/or angled portion 9 of handle 140 may be provided by two pieces that snap together (as exemplified by pieces 7*a* and 7*b* of FIG. 9) rather than by the single piece illustrated in FIG. 8. It will be understood however that this may be done even with a design that does not use the projecting beam 296 of FIG. 9 (e.g. it might be used in a design which uses the relatively short projection 96 of FIG. 8). In general, it will be understood that any portion of handle 140 might be provided in such a multi-piece format, or may be provided as a single piece, as may be desired. It will also be appreciated that while the features discussed above in regard to FIG. 9 have been illustrated in the same Figure for ease of presentation, it is not required that they must occur in combination with each other. That is, any of such features as a beam that extends forwardly through at least some of a front portion of handle 140, a reinforcing member that is connectable to handle 140, a scraping blade, and a through-opening in a cleaning pad to accommodate such a scraping blade, may be provided as desired (e.g., alone or in combination with any other feature presented in this disclosure).

In a variation of the approach exemplified, in FIG. 9, in some embodiments at least front portion 7 of shaft 4 of handle 140 may be provided by an elongate metal member. Such an arrangement may be achieved e.g. by omitting pieces 7*a* and 7*b* from the design of FIG. 8, with beam 296 then serving as front portion 7 of handle 140. In such cases, a support body 30 may be designed that can be attached (e.g., directly) to front portion 7 of beam 296. For example, as shown in exemplary manner in FIG. 10, rear end 34 of support body 30 may comprise a deflectable member 239 with a fin that is shaped to be received into a complementary receptacle (not shown in any Figure) in front portion 7 of beam 296.

Figure 10:
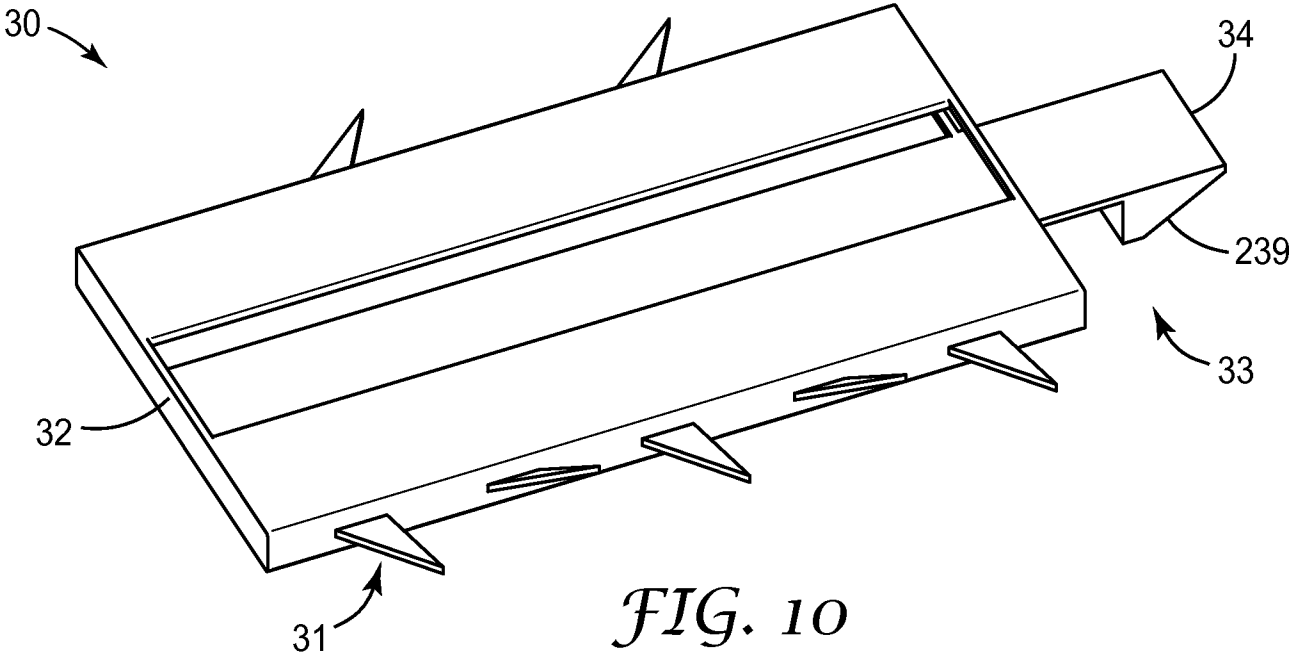
FIG. 10 is a side-top perspective view of another exemplary support body.

FIG. 10 also shows another design attribute that may be advantageous in some embodiments. Support body 30 as shown in FIG. 10 comprises a staggered-panel configuration that comprises through-passages (of the general type mentioned earlier herein) that allow fluid to pass through the support body from one major surface to the other, but in which the panels and the through-passages formed thereby are configured so that there are no through-passage edges that are oriented at least generally orthogonally (or substantially orthogonally, or strictly orthogonally) to the long axis of the support body. This can enhance the ability of a reinforcing member (e.g., of the general type described earlier herein and exemplified by reinforcing member 300 of FIG. 9) to be forwardly inserted into the interior of support body 30 without snagging on an edge that is oriented at least generally orthogonally to the direction of insertion of the reinforcing member). It will be further appreciated that a staggered-panel design as shown in FIG. 10 allows fluid to pass through the support body even though there may be no direct passage through the support body along an axis normal to the major plane of the support body. (That is, such a design is similar to a staggered board fence that can only be seen through when viewed at off-angles rather than when viewed from normal to the fence).

Figure 11:
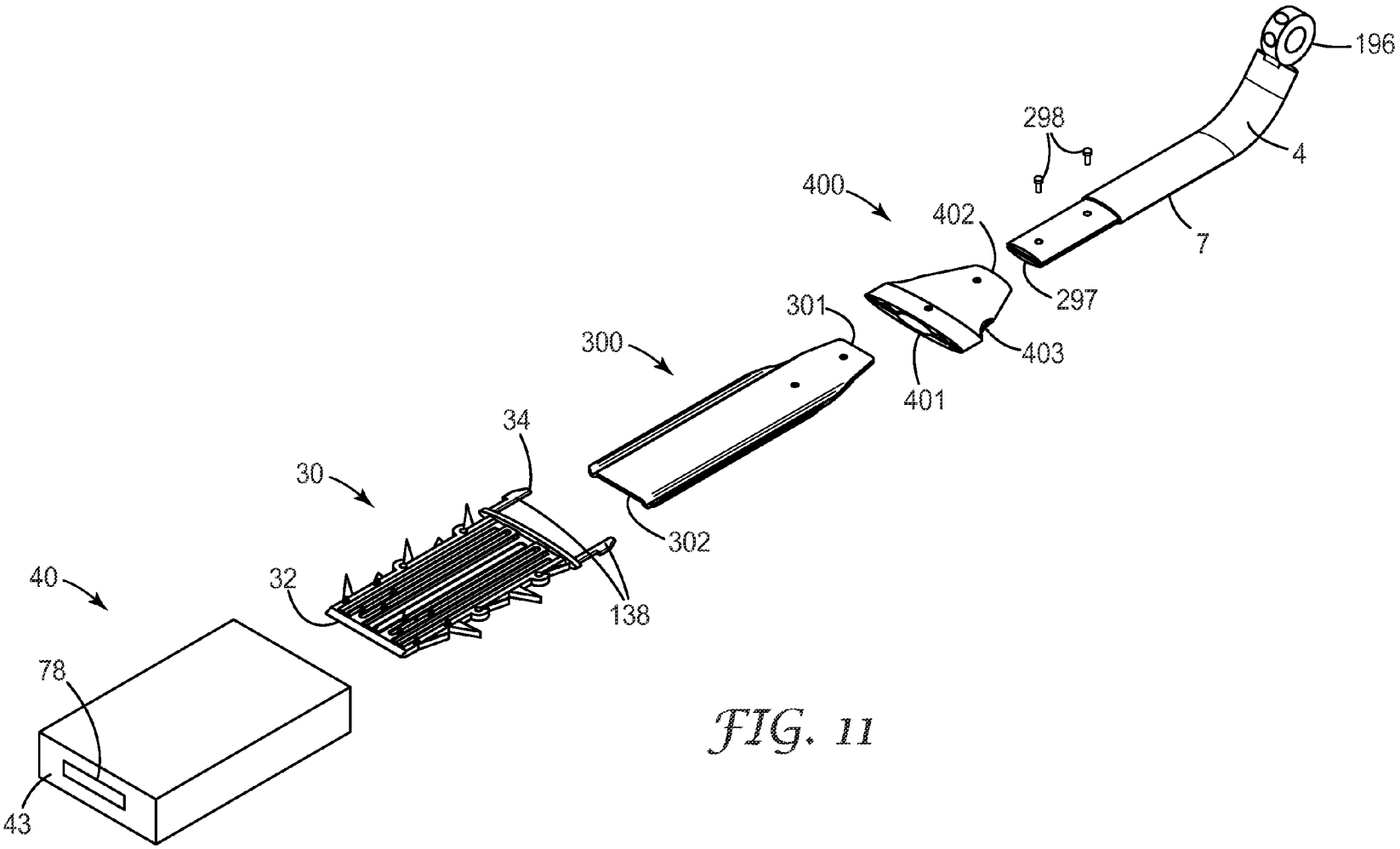
FIG. 11 is a side-top perspective exploded view of another exemplary cleaning pad, support body, and portion of a handle.

Still other features and designs that may be used are depicted in exemplary manner in FIG. 11 (in FIG. 11 certain components of rear, grippable handle portion 5 are omitted for ease of presentation as in FIG. 9; such components may be e.g. similar or identical to those shown in FIG. 8). In one such exemplary feature, sleeve 400 may be used to facilitate the detachable attaching of support body 30 to front section 7 of handle 140. In the illustrated embodiment, sleeve 400 comprises a hollow interior so that sleeve 400 can be rearwardly slidably mounted onto front portion 7 of handle 140. Rear end 301 of reinforcing member 300 can be rearwardly inserted through the interior of hollow sleeve 400 and can be seated into slot 297 of front portion 7 of handle 140. (The forward portion of reinforcing member 300 resides within support body 30 so as to provide e.g. stiffening, in similar manner to the arrangement discussed above with respect to FIG. 9). As illustrated in FIG. 11, one or more mechanical fasteners (e.g., screws 298) may be inserted through aligned, apertures in front portion 7 of handle 140, in reinforcing member 300, and in sleeve 400, to enhance the attaching of sleeve 400 and reinforcing member 300 to handle 140. Any suitable method of attachment may be used, however. Sleeve 400 may be made of any suitable material; e.g., injection molded plastic.

Figure 12:
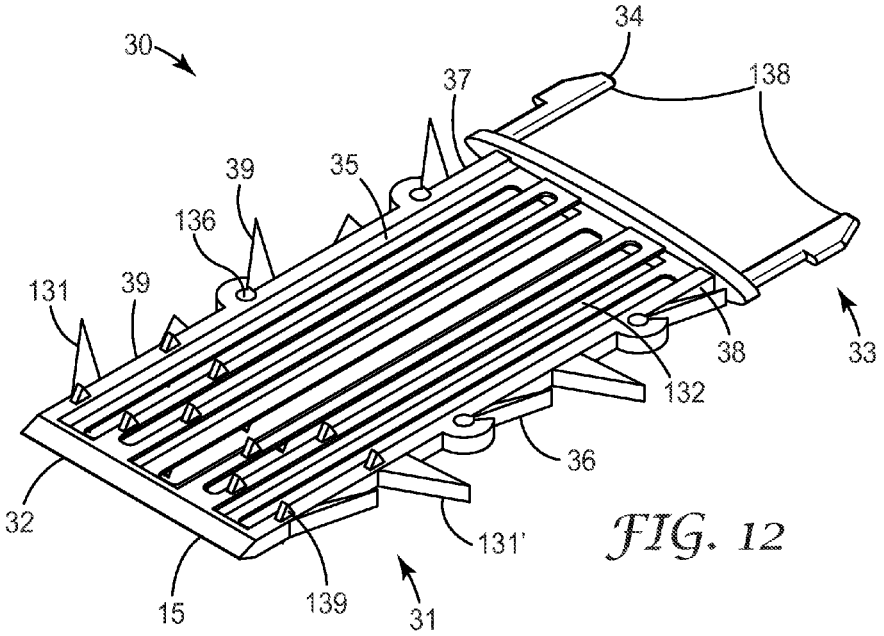
FIG. 12 is a side-top perspective view of the exemplary support body of FIG. 11.

As shown in more detail in the magnified view of FIG. 12, in this embodiment major rear portion 33 of support body 30 (that is, the portion that extends rearwardly from cleaning pad 40) does not comprise a hollow interior. Rather, it comprises two rearwardly-extending members 138, each of which comprises a laterally-outward-facing fin and each of which is laterally-inwardly-deflectable. As is evident from FIG. 11, continued urging of major rear portion 33 of support body 30 rearward into sleeve 400 will cause members 138 to deflect laterally inwardly, until they each reach a seating receptacle (e.g., apertures 403) of sleeve 400, at which point they will rebound into the receptacle thus detachably attaching support body 30 to handle 140. When it is desired to detach support body 30 and cleaning pad 40 from handle 140, members 138 can be pressed laterally inwardly (e.g., manually with the user's fingers) and support body 30 can then be pulled forwardly so as to detach it from sleeve 400 and thus from handle 140. (It will be appreciated that in some embodiments, sleeve 400 may be used to facilitate the detachable attaching of support body 30 to front portion 7 of handle 140, even if reinforcing member 300 is omitted.)

As mentioned above, cleaning pad 40 is a resilient cleaning pad that may be used for cleaning of e.g. commercial flyers as found in restaurants and the like. By resilient is meant that cleaning pad 40 is conformable at least to the extent of conforming somewhat to the shape of a surface against which cleaning pad 40 is pressed, but that, after the pressing force is removed, resilient pad 40 returns substantially to its previous shape and thickness. As such, resilient pad 40 will be distinguished from such soft, weak materials as would not return substantially to their previous shape and thickness after being used to clean a surface, and in particular will be distinguished from materials that are so weak and soft as to be significantly damaged or destroyed when used to clean a surface. As such, resilient pad 40 by definition excludes cellulosic materials, water-soluble or water-softenable materials, and the like, that are commonly used for relatively non-aggressive cleaning operations such as general household use and the like.

In view of the above discussions, a cleaning pad 40 may comprise any suitable fibrous web (in this context, the term pad specifically excludes brushes and the like) that can meet the above specifications. In some embodiments, the cleaning pad is a fryer cleaning pad. It will be recognized that fryers are often still hot while being cleaned, and can have oxidized material baked onto the fryer surface that may be difficult to remove. Thus, a suitable fryer cleaning pad material should be able to tolerate such temperatures, and should survive the physical rigors of the cleaning process.

In some embodiments, cleaning pad 40 may be comprised of a fibrous nonwoven web comprising abrasive particles attached to the fibers thereof. In some particular embodiments, cleaning pad 40 may comprise a coherent bonded-fiber nonwoven web made of interlaced randomly disposed flexible organic thermoplastic fibers at least some of which are adhesively bonded together by binder at points where the fibers intersect and contact each other, to form a web having three-dimensionally integrated structure. Abrasive particles may be distributed throughout the web and bonded to the web by binder. The interstices between the fibers of the web are substantially unfilled with binder or abrasive. Such webs are typically flexible and readily compressible and, upon release of pressure, are capable of recovering substantially completely to its initial uncompressed form. Examples of webs of this type are disclosed in U.S. Pat. No. 2,958,593, and are available from 3M Company, St. Paul, Minn. under the trade designation SCOTCH-BRITE.

In some particular embodiments, cleaning pad 40 may comprise a coherent bonded-fiber nonwoven web made of first and second crimped, staple, organic bicomponent thermoplastic fibers, in which at least some of the first and second fibers of the web are melt-bonded together at least at a portion of the points where they contact each other. At least a portion of the first and second fibers of one major surface of the nonwoven web may have an abrasive coating (e.g., abrasive particles) bonded thereto, and at least a portion of the first and second fibers of the interior region may have no abrasive coating bonded thereto. Examples of webs of this type are disclosed in U.S. Pat. No. 5,685,935.

In some embodiments, cleaning pad 40 may comprise a coherent bonded-fiber nonwoven web made of inter-engaged continuous coiled or three-dimensionally undulated filaments of resilient thermoplastic polymer. At least some of the filaments are autogeneously bonded together or removably welded together at points of mutual contact to form a handleably integrated structure. The web may comprise abrasive granules dispersed throughout the web and bonded to the filaments by binder. Examples of webs of this type are disclosed in U.S. Pat. Nos. 3,837,988 and 4,227,350.

In some embodiments, cleaning pad 40 may comprise a coherent bonded-fiber nonwoven web that is a sponge-like, compressible, web made of randomly intermingled and randomly bonded hydrophobic fibers. The randomly intermingled fibers are bonded together either through fusion or with a binder at randomly spaced points where the fibers cross. The fibers of the web define, in effect, walls of a large multiplicity of open cells, which impart a high void volume to the web. Examples of webs of this type are disclosed in U.S. Pat. No. 3,537,121 and U.S. Pat. No. 3,910,284.

Slit-like cavity 45 can be provided in cleaning pad 40 in any suitable manner. In some embodiments, slit-like cavity 45 may be a hot-knife-cut cavity. That is, a cleaning pad 40 may be provided in the form of a block or slab, and a knife blade (which may be energized if desired by any energy source, including thermal, ultrasonic or other vibratory energy, etc., in order to enhance the cutting ability) may be pressed against rear face 44 thereof and inserted forwardly thereinto to form cavity 45. It will be appreciated that such a hot-knife-cut cavity may be recognizable e.g. by cut-ends of at least some of the fibers that define the interior surfaces of cleaning pad 40 that define cavity 45, and also e.g. by any slight melting of the cut ends that may result from the hot-knife-cutting process. In some embodiments of this type, cleaning pad 40 may be provided in the form of a monolithic fibrous block or pad that has been cut with a knife to form a slit-like, rearwardly-open-ended cavity. Such arrangements may be particularly suitable in the case of a cleaning pad 40 that is relatively thick (e.g., about 2 cm, 3 cm, or more in thickness). In some embodiments of this type, cleaning pad 40 may comprise a closed front end 43 e.g. as shown in FIG. 1 (that is, in such embodiments pad 40 does not comprise a forwardly-open-ended cavity); in further embodiments, cleaning pad 40 is a monolithic pad that has no seams or joints. However, in other embodiments cleaning pad 40 may comprise a forwardly-open-ended cavity that is shaped and sized to accommodate a scraping blade, as shown e.g. in FIG. 9 and as discussed earlier herein.

Figure 13:
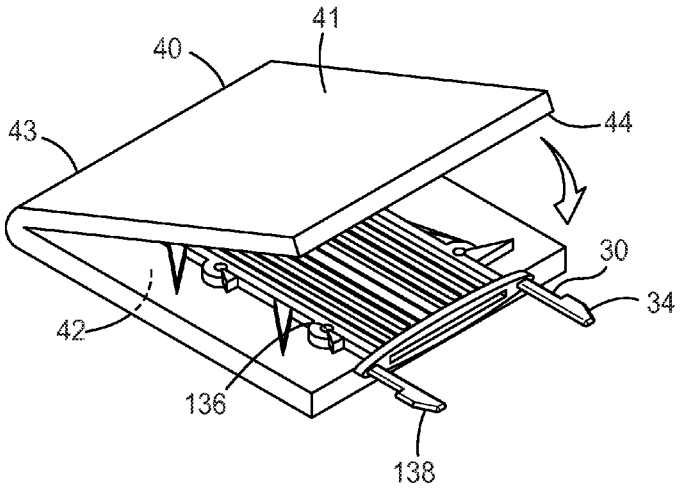
FIG. 13 is a side-top perspective view of an exemplary sheet being folded over to make an exemplary cleaning pad.

In other embodiments, a slit-like cavity can be provided in cleaning pad 40 by starting with a (relatively thin, e.g. about half the desired thickness of cleaning pad 40) precursor sheet and folding it over to form cleaning pad 40 comprising a slit-like cavity, as shown in exemplary embodiment in FIG. 13. (It will be appreciated that the exemplary support body 30 of FIG. 13 is the same type as that of FIG. 12.) Support body 30 can thus comprise designs and features that facilitate the use of support body 30 with this cleaning pad design. Thus, in some embodiments, first and/or second major surfaces 35 and/or 36 of support body 30 may comprise a plurality of barbs 139 (as depicted in exemplary manner in FIG. 12) that are configured to entangle with fibers of cleaning pad 40. In some embodiments, one or more receptacles 139 may be provided in support body 30 (as depicted in FIG. 12). Such an arrangement enables a mechanical fastener (e.g., a rivet) to be passed through a first layer (e.g., an upper layer) of cleaning pad 40 and to be passed into receptacle 136 (and optionally through a second layer (e.g., a lower layer) of cleaning pad 40. Any number of such receptacles, and associated mechanical fasteners (of any suitable type) may be used. Advantageously, such fasteners may be non-detachable. In addition to these, any other attachment method such as heat staking, ultrasonic welding, adhesives, etc., may be used. The above-discussed methods of making a cleaning pad 40, and of non-removably attaching such a cleaning pad to a support body, may be particularly useful in the case of a cleaning pad 40 that is relatively thin (e.g., less than about 2 cm, 1 cm, or ½ cm, in thickness).

In some embodiments of this type, the precursor sheet may be may be rearwardly wrapped (e.g., as shown in FIG. 13) to form cleaning pad 40. In some such cases, cleaning pad 40 may comprise a closed front end 43 (similar to that shown in FIG. 1). However, in other embodiments 40 may comprise a forwardly-open-ended cavity (e.g., by providing a slit in the precursor sheet somewhere along the folding axis). In other embodiments, the thin precursor sheet may be laterally wrapped (from the side). And, in some embodiments the precursor sheet may be wrapped onto a support body (as shown in FIG. 13) in the process of making the assembled support body/cleaning pad product (with the slit-like cavity thus being formed around the support body); in other embodiments, the precursor sheet may be wrapped to form a cleaning pad containing a slit-like cavity, and a support body can then be inserted into the slit-like cavity.

It will be appreciated that a support body 30 of the general type shown in FIGS. 11-13 may be particularly advantageous in being usable both with relatively thick pads (in which e.g., edge-mounted barbs 131 and 131' may serve to provide the attachment of cleaning pad 40 to support body 30), and also with relatively thin pads and/or pads that are wrapped as described above (in which e.g. major-surface-mounted barbs 139 and/or rivets inserted into receptacles 136 may serve to provide the attachment). Such dual-purpose ability allows a single design of support body to be used with cleaning pads of both designs.

Figure 14:
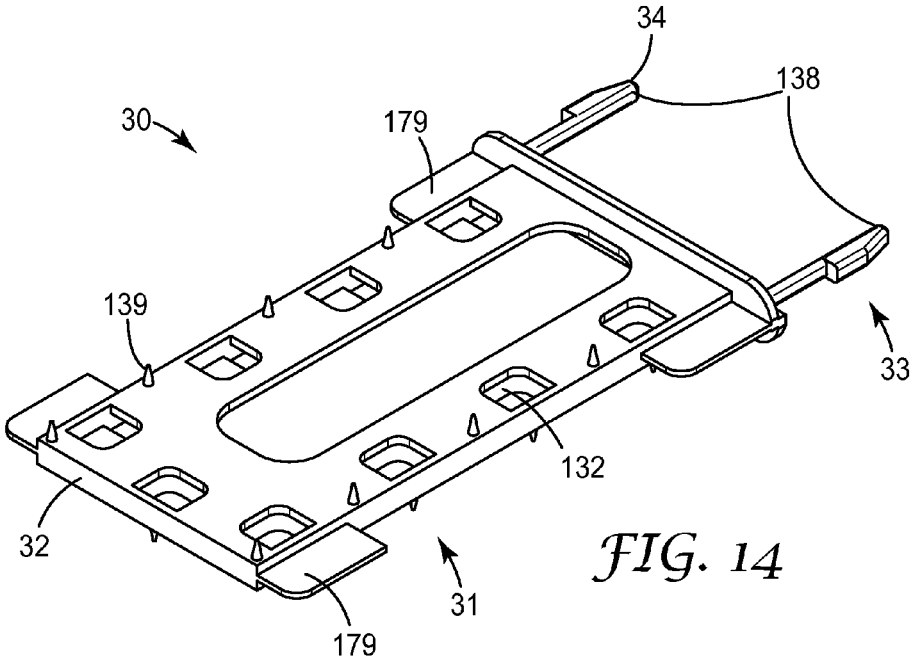
FIG. 14 is a side-top perspective view of another exemplary support body.
Figure 15:
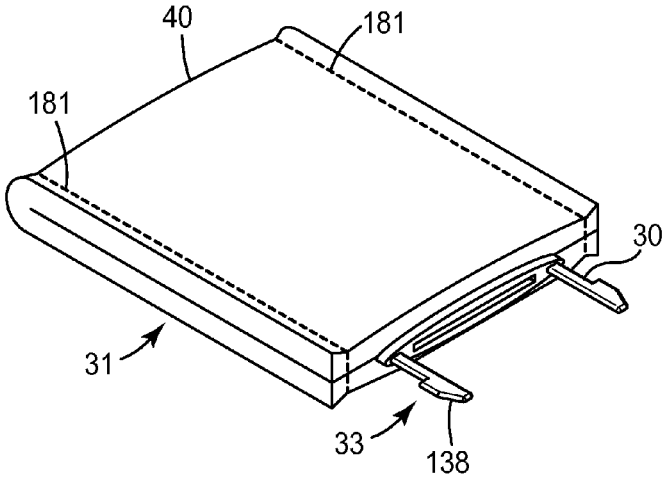
FIG. 15 is a side-top perspective view of another exemplary sheet as folded over a support body to make an exemplary cleaning pad.

Still other possible variations in the design and features of support body 30 and pad 40 are depicted in exemplary manner in FIGS. 11 and 15. Support body 30 as depicted in FIG. 14 is somewhat similar to that shown in FIG. 12 with several tabs 179 being provided that protrude from the lateral minor edges of major front portion 31 of the support body. These tabs may be used e.g. in conjunction with a pad that is made from folding a thin sheet over support body 30, in generally similar manner to that discussed above with respect to FIG. 13. However, in a variation of the above approach, sewing seams (e.g., lines, although they do not have to be strictly straight lines) 181 may be provided along the two minor edges of the pad. That is, after a thin sheet is folded generally as shown in FIG. 13 (to form a fully-folded sheet as shown in FIG. 15), a sewing apparatus can be used to sew the side edges of the facing-sheet portions to each other. In some embodiments, the sewing thread may be actually passed through portions of tabs 179 to enhance the non-removable attaching of the pad to the support body; however, in other embodiments the attaching of the side edges to each other may provide a snug enough fit of major front portion 31 of support body 30 within the slit-like cavity of the formed pad 40 that (e.g., as facilitated by the action of barbs e.g. 139) the formed pad and the support body may be satisfactorily non-removably attached to each other without passing the sewing thread into such tabs. Thus, the sewable attaching of a sheet/pad to such a tab, and indeed the provision of such a tab, is optional and may only be present in certain embodiments.

While some of the various designs and features discussed in the preceding pages have been grouped into specific Figures, it will be understood that this was done for convenience of presentation and that it is not required that such features must necessarily occur in combination with each other (unless of course they are specified to be provided in combination). Any desired combination is encompassed by the disclosures herein. By way of particular example, through-passages as provided by a staggered-panel arrangement of the general type shown in FIG. 10, may be used in a support body that comprises e.g. rearwardly-extending members 138, and/or that comprises barbs 139 that protrude from first and/or second major surfaces 35 and/or 36 of the support body (both as shown in exemplary embodiment in FIGS. 12 and 14).

Figure 16:
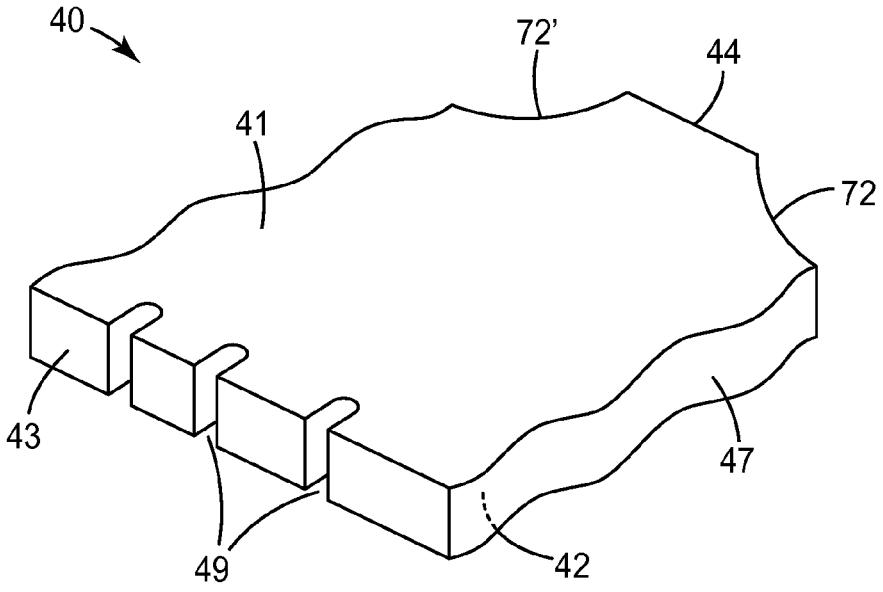
FIG. 16 is a side-top perspective view of another exemplary cleaning pad.

Cleaning pad 40 may comprise first and second major cleaning surfaces 41 and 42, forward and rearward edges 43 and 44, and first and second lateral (side) edges 47 and 48, as shown e.g. in FIGS. 1, 2, 4 and 9. Such edges may also be used for cleaning, and as such may comprise features that enhance such ability. For example, in the particular embodiment exemplified in FIG. 16, rear edge 44 of pad 40 may comprises two rear edge sections (which sections may laterally flank the rearwardly-open end of slit-like cavity 45, which rear edge sections may respectively comprise concave contours 72 and 72'. Such arrangements can facilitate e.g. the cleaning of the underside of tubular items, e.g. fryer heating elements. In some embodiments, an edge of cleaning pad 40, e.g. forward edge 43, may comprise one or more slits 49 as shown in exemplary embodiment in FIG. 16, which slits may e.g. be spaced across the width of forward edge 43. In some embodiments, at least a portion of any edge of cleaning pad 40 may be serrated (meaning having undulating (e.g., scalloped) areas with a radius of curvature of less than 1 cm), as exemplified by side edge 47 of FIG. 16. In some embodiments a front portion of cleaning pad 40 that will frontwardly abut the front end 32 of support body 30 can optionally comprise a reinforced area 46 (provided e.g. by way of a reinforcing scrim, seam, or mesh, by a densified area of the pad, etc.), as indicated in FIG. 16.

Figure 17:
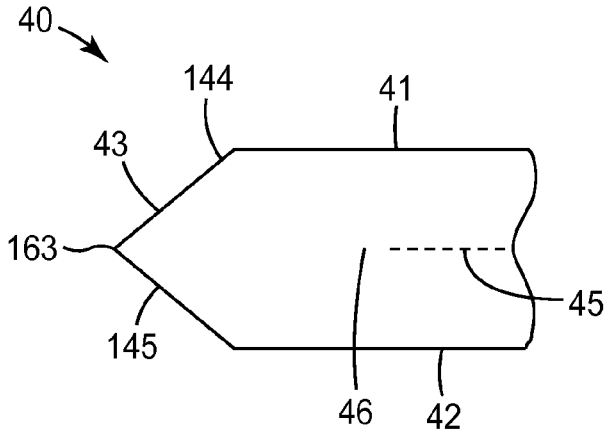
FIG. 17 is a side view of a portion of another exemplary cleaning pad.

Forward and rearward edges 43 and 44, and side edges 47 and 48, of cleaning pad 40, may have any suitable profile. For example, edges 43, 47 and 48 as shown in the exemplary embodiment of FIG. 1 are not noticeably tapered or wedge-shaped. In other embodiments, an edge can comprise a tapered profile e.g. so as to be wedge-shaped. By way of specific example, in FIG. 17 is shown (in side view) a cleaning pad 40 in which forward edge 43 comprises a tapered profile configured such that forward edge 43 comprises first and second forward edge surfaces 144 and 145 that meet at nose 163. In various embodiments, forward edge surfaces 144 and 145 may be angled away from each other (i.e., with reference to the major planes thereof) by at least 25, 45, 65, or 85 degrees (with a divergence angle of approximately 90 degrees being shown in the exemplary illustration of FIG. 17). In some embodiments, forward edge 43 may comprise an asymmetrically tapered profile so as to comprise an asymmetric wedge shape, such that the surface area of a first edge surface is larger than the surface area of a second edge surface. In various embodiments, the area of a first edge surface may exceed that of second edge surface by at least 20, 40, 60 or 80%. In some cases, the asymmetry may be so great that the area of the first edge surface exceeds that of the second surface by 90, 95, or 98%. It will be understood that while the above discussions have focused on forward edge 43, any edge of cleaning pad 40 may be similarly tapered or asymmetrically tapered. In various embodiments, one or more edges may be tapered and/or asymmetrically tapered, with one or more other edges not being tapered. It will be appreciated that such tapered edges may facilitate cleaning of tight crevices, corners, and the like.

In some particular embodiments, cleaning pad 40 may be comprised of a multiple (e.g., first and second) layers. In some embodiments, such layers may be exposed layers, which differ in e.g. abrasiveness or scouring power. For example, a first layer might comprise abrasive particles with e.g. a Mohs hardness of greater than 8, and a second layer might comprise abrasive particles of less abrasiveness, e.g. with Mohs hardness in the range of 3-7. Such combinations are discussed in further detail in U.S. Pat. No. 4,078,340, and may allow a portion of pad 40 of desired abrasiveness to be brought to bear onto a particular surface to be cleaned. (For example, it might be desired to use a cleaning layer of lower abrasiveness to clean e.g. a heating element that has a protective coating.) In other embodiments, a multilayer pad 40 may comprise a first layer (e.g., an outer layer) that is a cleaning layer comprising abrasive particles, and at least a second layer (e.g., an inner layer) that is a reservoir layer comprising a liquid cleaning composition, wherein the reservoir layer is configured to release at least some of the liquid cleaning composition into the cleaning layer upon the application of pressure to the reservoir layer e.g. in the act of manually pressing cleaning pad 40 against a surface to be cleaned. In still further embodiments, a multilayer cleaning pad 40 can comprise an asymmetrically layered arrangement, meaning that one of the layers is at least 20% thicker than another of the layers. In various embodiments, the thicker layer can be at least 40, 60, or 80% thicker than another of the layers. Cleaning pad 40 may be any suitable size. In some embodiments, cleaning pad 40 may be about e.g. 10-13 cm long (i.e., along the front-rear axis of cleaning tool 1), and may be about e.g. 7-10 cm wide (i.e., in lateral dimension).

Tool 1 formed by detachably attaching cleaning pad 40 to a handle (by way of support body 30) may be used to manually clean any desired surface, with the term manually meaning tool 1 is held by hand by a person and is moved by hand (without any kind of motorized apparatus) across the surface. Tool 1 may be particularly suitable for cleaning surfaces that are e.g. deep in a container (e.g., surfaces below heating elements of a fryer), for cleaning heating elements themselves (such heating elements are often elongated tubes), and so on. In particular, tool 1 may be useful in cleaning the underside of items such as heating elements that might otherwise be quite difficult to reach and clean. In at least some embodiments, at least components of cleaning tool 1 that contact or most closely approach hot surfaces (as well as cleaning pad 40) may be made of materials that can withstand temperatures up to or even greater than the typical operating temperature of fryers to be cleaned (since, in some cases, cleaning may be performed with a fryer still at a high temperature). It must be emphasized however that the use of cleaning pad 40 and of tool 1 is not limited to the cleaning of fryers and the like.

In some embodiments, cleaning pad 40 as disclosed herein may be disclosed as a kit comprising two or more cleaning pads 40 that are packaged together. In such embodiments, it may be advantageous to provide cleaning pads that differ from each other in flexibility, as may be desired for various uses. This can be provided (even if the cleaning pads themselves are similar or even identical) e.g. by varying the properties of the support body (specifically, the properties of the front portion of the support body, that is inserted into the slit-like cavity of the cleaning pad). For example a support body may be made shorter in its long-axis dimension (e.g. so that it extends less for forward into a slitlike cavity), may be thinner in its lateral width, may be thinner in its shortest-axis thickness, may have more thin sections or through-holes, may be made of a less stiff material, and so on, any of which may provide a cleaning pad that is more pliable and less stiff than a cleaning pad that comprises a stiffer support body in a slit-like cavity thereof. In some embodiments, a first cleaning pad may comprise a first support body that resides within the open-ended slit-like cavity of the first cleaning pad so that a front end of the first support body is positioned at a distance from a front end of the first cleaning pad, and a second cleaning pad may comprise a second support body that resides within the open-ended slit-like cavity of the second cleaning pad so that a front end of the second support body is positioned at a distance from the front end of the second cleaning pad, that is greater by at least 20% than the distance from which the front end of the first support body is positioned from the front end of the first cleaning pad. In further embodiments, the distance between the front end of a second support body and the front end of its cleaning pad, may be greater than the distance from which the front end of a first support body is from its cleaning pad, by a factor of at least 30, 40, or 50%. Thus in any of the above-described ways, a kit may be provided that contains several cleaning pads of different flexibilities. If different support bodies which impart different flexibility to their respective cleaning pads are provided in this manner, the different support bodies (and/or the different cleaning pads) may be color-coded or otherwise marked so that it is easy to determine which cleaning pad corresponds to a desired flexibility.

In some embodiments, cleaning pads 40 and handle 140 can be provided as a cleaning system, e.g. a fryer cleaning system, comprising a kit in which one or more handles 140 may be packaged along with at least two cleaning pads. Such kits may also optionally include one or more of: at least one cleaning composition (e.g., that can withstand a temperature at least up to the operating temperature of a fryer to be cleaned); a rinse solution for removing residual cleaning composition; an absorbent material (e.g., in the form of one or more pads) which may be convenient e.g. for removing of excess grease, cleaning composition, and/or rinsing solution; personal protective equipment (e.g., gloves, eyewear, etc.); and, instructions for use of the cleaning tool and other components of the kit. Such kits may also contain one or more items such as scraping blades, wire brushes, and so on, that are configured so as to be attachable to handle 140.

Cleaning tools, kits containing such tools, etc., that are disclosed herein can be used in the cleaning of any desired surface. In particular embodiments, the tools and/or kits can be used to clean any suitable fryer (e.g., whether electric or gas). The tools can be used in combination with any suitable cleaning compositions (e.g., commonly used aqueous-alkali formulations), and/or in combination with such well-known cleaning methods as cold-soak and boil-out cleaning methods.

LIST OF EXEMPLARY EMBODIMENTS

Embodiment 1

An assembly comprising: resilient cleaning pad with a front end and a rear end and with interior surfaces that at least partially define a rearwardly-open-ended slit-like cavity in the cleaning pad; and, a support body, wherein a first, major front portion of the support body resides within the rearwardly-open-ended slit-like cavity of the cleaning pad and is mechanically secured to the interior surfaces of the cleaning pad so that the cleaning pad and the support body are non-separably attached to each other, and wherein a second, major rear portion of the support body protrudes rearwardly from the rearwardly-open-ended slit-like cavity and comprises a support body attachment mechanism configured to be detachably attached to a handle.

Embodiment 2

The cleaning pad of embodiment 1 wherein the support body comprises a first major side with a first major surface and a second major side with a second major surface, and a first minor lateral edge and a second minor lateral edge, and wherein the first and second minor lateral side edges of the first, major front portion of the support body, each comprise a plurality of rearwardly angled barbs that are configured to entangle with fibers of the cleaning pad to provide or enhance the mechanical securing of the first, major front portion of the support body to the interior surfaces of the cleaning pad.

Embodiment 3

The cleaning pad of embodiment 2 wherein the rearwardly angled barbs are spaced along each minor lateral edge of the first, major front portion of the support body, and are configured so that barbs of neighboring pairs of barbs on each minor edge of the support body, are angled away from a major plane of the support body, in generally different directions.

Embodiment 4

The cleaning pad of any of embodiments 1-3 wherein the first, major front portion of the support body comprises a plurality of through-passages that extend between first and second major surfaces of the first, major front portion of support body.

Embodiment 5

The cleaning pad of any of embodiments 1-4 wherein the first, major front portion of the support body comprises a scraping blade and wherein the cleaning pad comprises a forwardly-open through-hole that is sized and shaped to allow a front edge of the scraping blade to positioned evenly therewith or to protrude forwardly therethrough.

Embodiment 6

The cleaning pad of any of embodiments 1-5 wherein the support body and the cleaning pad are not melt-bonded or adhesively bonded to each other and wherein no mechanical fastener is used to non-separably attach the cleaning pad and the support body to each other other than the mechanical securing of the first, front portion of the support body to the interior surfaces of the cleaning pad.

Embodiment 7

The cleaning pad of any of embodiments 1-6 wherein the support body comprises a first major side with a first major surface and a second major side with a second major surface, and wherein the first and second major surfaces of the first, major front portion of the support body, each comprise a plurality of barbs that protrude outwardly therefrom and that are configured to entangle with fibers of the cleaning pad to provide or enhance the mechanical securing of the first, major front portion of the support body to the interior surfaces of the cleaning pad.

Embodiment 8

The cleaning pad of any of embodiments 1-7 wherein the cleaning pad is formed from a precursor sheet that is wrapped to form the cleaning pad comprising the rearwardly-open-ended slit-like cavity.

Embodiment 9

The cleaning pad of any of embodiments 1-8, further comprising an elongated handle comprising a front portion with a handle attachment mechanism that is detachably attached to the support body attachment mechanism so that the elongated handle and the support body are detachably attached to each other, and comprising a rear portion that is a grippable portion.

Embodiment 10

The cleaning pad of embodiment 9 wherein the support body attachment mechanism comprises at least one boss that is supported by a deflectable flange that is deflectably connected to the support body by a molded plastic living hinge of the molded plastic support body, and wherein the handle attachment mechanism of the front portion of the elongated shaft of the handle comprises an aperture that is configured to admit at least a portion of the boss of the support body attachment mechanism thereinto.

Embodiment 11

The cleaning pad of embodiment 9 wherein the support body attachment mechanism comprises two members that extend rearwardly from the support body and are laterally-inwardly-deflectable and comprise a laterally-outward-facing fin configured to be received into a seating receptacle of a sleeve that is provided on the front portion of the elongated shaft of the handle.

Embodiment 12

The cleaning pad of embodiment 9 wherein a portion of the elongated handle between the front portion and the rear, grippable portion is an angled portion that has a long axis that is oriented away from a long axis of a front portion of the elongated handle by at least about 20 degrees.

Embodiment 13

The cleaning pad of embodiment 12 wherein the elongated handle comprises a hinged connection, such that an angle between a long axis of the rear, grippable portion of the handle, and a long axis of the front portion of the handle, can be changed.

Embodiment 14

The cleaning pad of embodiment 13 wherein the hinged connection allows the grippable portion of the elongated handle to be positioned in a first position in which a long axis of the grippable portion of the elongated shaft is aligned generally parallel to, but offset by at least about 2 cm from, a long axis of the front portion of the handle.

Embodiment 15

The cleaning pad of embodiment 14 wherein the hinged connection further allows the grippable portion of the elongated handle to be positioned in a second position in which the grippable portion of the handle is aligned generally perpendicular to a long axis of the front portion of the handle.

Embodiment 16

The cleaning pad of embodiment 15 wherein the hinged connection further allows the grippable portion of the elongated handle to be positioned in a third position in which at least a part of the grippable portion of the handle is in overlapping relation with a portion of the cleaning pad.

Embodiment 17

The cleaning pad of embodiment 16 wherein the grippable portion of the elongated handle comprises an actuating mechanism that can be actuated to unlock the grippable portion so that it can be rotated away from one of the first, second or third positions, at least into another position of the first, second or third positions.

Embodiment 18

The cleaning pad of embodiment 17 wherein the actuating mechanism comprises a biasing mechanism configured so that the grippable portion of the elongated handle automatically locks into position when the grippable portion of the handle is rotated into any one of the first, second or third positions, unless a user applies force to resist the biasing mechanism.

Embodiment 19

A kit comprising at least first and second cleaning pads as described in embodiment 1.

Embodiment 20

The kit of embodiment 19 wherein the first cleaning pad comprises a first support body that resides within the open-ended slit-like cavity of the first cleaning pad so that a front end of the first support body is positioned at a distance from a front end of the first cleaning pad, and wherein the second cleaning pad comprises a second support body that resides within the open-ended slit-like cavity of the second cleaning pad so that a front end of the second support body is positioned at a distance from the front end of the second cleaning pad, that is greater by at least 20% than the distance from which the front end of the first support body is positioned from the front end of the first cleaning pad.

Embodiment 21

The kit of any of embodiments 19-20 wherein the kit further comprises at least one handle with a front portion with a handle attachment mechanism that is detachably attachable to the support body attachment mechanism of the support body, and with a rear portion that is a grippable portion, and wherein the handle is packaged in the same package with the first and second cleaning pads but is not attached to the first or second cleaning pads.

Embodiment 22

A method of cleaning a surface comprising manually manipulating a cleaning pad of any of embodiments 9-21 so that the cleaning pad is brought into contact with a surface to be cleaned and is manually moved back and forth across the surface to be cleaned.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention not merely those representative designs that were chosen to serve as exemplary illustrations. Thus, the scope of the present invention should not be limited to the specific illustrative structures described herein, but rather extends at least to the structures described by the language of the claims, and the equivalents of those structures. To the extent that there is a conflict or discrepancy between this specification as written and the disclosure in any document incorporated by reference herein, this specification as written will control.

What is claimed is:

1. An assembly comprising:

a resilient cleaning pad with a front end and a rear end and with interior surfaces that at least partially define a rearwardly-open-ended slit-like cavity in the cleaning pad;

and, a support body, wherein a first, major front portion of the support body resides within the rearwardly-open-ended slit-like cavity of the cleaning pad and is mechanically secured to the interior surfaces of the cleaning pad so that the cleaning pad and the support body are non-separably attached to each other, and wherein a second, major rear portion of the support body protrudes rearwardly from the rearwardly-open-ended slit-like cavity and comprises a support body attachment mechanism configured to be detachably attached to an elongated handle comprising a front portion with a handle attachment mechanism that is detachably attached to the support body attachment mechanism so that the elongated handle and the support body are detachably attached to each other, and comprise a rear portion that is a grippable portion;

wherein a portion of the elongated handle between the front portion and the rear, grippable portion is an angled portion that has a long axis that is oriented away from a long axis of a front portion of the elongated handle by at least about 20 degrees;

wherein the elongated handle further comprises a hinged connection, such that an angle between a long axis of the rear, grippable portion of the handle, and a long axis of the front portion of the handle, can be changed; and wherein the hinged connection allows the grippable portion of the elongated handle to be positioned in a first position in which a long axis of the grippable portion of the elongated shaft is aligned generally parallel to, but offset by at least about 2 cm from, a long axis of the front portion of the handle.

2. The cleaning pad of claim 1 wherein the hinged connection further allows the grippable portion of the elongated handle to be positioned in a second position in which the grippable portion of the handle is aligned generally perpendicular to a long axis of the front portion of the handle.

3. The cleaning pad of claim 2 wherein the hinged connection further allows the grippable portion of the elongated handle to be positioned in a third position in which at least a part of the grippable portion of the handle is in overlapping relation with a portion of the cleaning pad.

4. The cleaning pad of claim 3 wherein the grippable portion of the elongated handle comprises an actuating mechanism that can be actuated to unlock the grippable portion so that it can be rotated away from one of the first, second or third positions, at least into another position of the first, second or third positions.

5. The cleaning pad of claim 4 wherein the actuating mechanism comprises a biasing mechanism configured so that the grippable portion of the elongated handle automatically locks into position when the grippable portion of the handle is rotated into any one of the first, second or third positions, unless a user applies force to resist the biasing mechanism.

6. A kit comprising a first and second cleaning pad and a first and second support body, wherein the first and second resilient cleaning pad have a front end and a rear end and with interior surfaces that at least partially define a rearwardly-open-ended slit-like cavity in the cleaning pad;

and, wherein a first, major front portion of the first and second support bodies resides within the rearwardly-open-ended slit-like cavity of the respective cleaning pad and is mechanically secured to the interior surfaces of the respective cleaning pad so that the each cleaning pad and its respective support body are non-separably attached to each other, and wherein a second, major rear portion of the first and second support bodies protrudes rearwardly from the rearwardly-open-ended slit-like cavity and comprises support body attachment mechanisms configured to be detachably attached to a handle;

wherein the first support body resides within the open-ended slit-like cavity of the first cleaning pad so that a front end of the first support body is positioned at a distance from a front end of the first cleaning pad, and wherein the second support body resides within the open-ended slit-like cavity of the second cleaning pad so that a front end of the second support body is positioned at a distance from the front end of the second cleaning pad, that is greater by at least 20% than the distance from which the front end of the first support body is positioned from the front end of the first cleaning pad.

7. The kit of claim 6 wherein the kit further comprises at least one handle with a front portion with a handle attachment mechanism that is detachably attachable to the support body attachment mechanisms, and with a rear portion that is a grippable portion, and wherein the handle is packaged in a single package with the first and second cleaning pads but is not attached to the first or second cleaning pads.

* * * * *